US007275731B1

(12) United States Patent
Shinault

(10) Patent No.: US 7,275,731 B1
(45) Date of Patent: Oct. 2, 2007

(54) TELESCOPICALLY ADJUSTABLE SUPPORT BRACE

(76) Inventor: Edwin K. Shinault, P.O. Box 152, 2153 Richvale Hwy., Richvale, CA (US) 95974

( * ) Notice: Subject to any disclaimer, the term of this patent is extended or adjusted under 35 U.S.C. 154(b) by 0 days.

(21) Appl. No.: 10/752,625

(22) Filed: Jan. 8, 2004

(51) Int. Cl.
*E04G 17/14* (2006.01)
*E04G 25/06* (2006.01)

(52) U.S. Cl. ..... 249/216; 248/354.5; 248/354.6

(58) Field of Classification Search ..... 248/217.2, 248/354.5, 354.6, 216.1, 57; 52/739.1, 291; 410/145, 146, 147, 148, 151; 249/216
See application file for complete search history.

(56) References Cited

U.S. PATENT DOCUMENTS

| | | | | | |
|---|---|---|---|---|---|
| 446,480 | A * | 2/1891 | Stebbins | 160/81 |
| 891,897 | A * | 6/1908 | Astrom | 254/101 |
| 1,464,427 | A * | 8/1923 | Hewitt | 52/291 |
| 2,350,113 | A * | 5/1944 | Hurley | 248/354.6 |
| 2,630,606 | A * | 3/1953 | Joyce | 52/291 |
| 3,300,941 | A * | 1/1967 | Heirich | 52/739.1 |
| 3,518,421 | A * | 6/1970 | Cogdill | 248/57 |
| 3,612,463 | A * | 10/1971 | Grant | 248/354.5 |
| 3,892,378 | A * | 7/1975 | Lane | 248/354.5 |
| 4,052,031 | A | 10/1977 | Melfi | |
| 4,202,145 | A | 5/1980 | Coulter et al. | |
| 4,518,141 | A * | 5/1985 | Parkin | 248/57 |
| 4,659,051 | A * | 4/1987 | Propp et al. | 248/57 |
| 4,737,056 | A * | 4/1988 | Hunt | 410/151 |
| 4,949,935 | A | 8/1990 | Lee | |
| 5,018,918 | A * | 5/1991 | Jacobs et al. | 410/145 |
| 5,085,398 | A | 2/1992 | Holcomb et al. | |
| 5,219,473 | A | 6/1993 | Sandwith | |
| 5,393,033 | A | 2/1995 | Wilson | |
| 6,086,029 | A * | 7/2000 | Oliver | 248/200.1 |
| 6,247,882 | B1 * | 6/2001 | Huang | 410/151 |
| 6,394,410 | B1 | 5/2002 | Thompson | |
| 6,519,906 | B2 | 2/2003 | Yost et al. | |
| 6,640,509 | B2 * | 11/2003 | Clewis | 248/354.5 |
| 6,742,975 | B2 * | 6/2004 | Trine et al. | 410/151 |

* cited by examiner

*Primary Examiner*—Michael Safavi
(74) *Attorney, Agent, or Firm*—Robert C. Montgomery

(57) ABSTRACT

A telescopically adjustable support brace is used to hold concrete form work at the proper linear distance during pouring operations. The brace comprises a pair of crossbars and telescoping adjustable arms that are locked by a pin inserted through aligned apertures. At the distal ends of each arm, a serrated cleat for digging into the form wall and prevent slippage. The cleats are connected to the arms by a threaded rod, permitting fine adjustments via mateable threads. The crossbars are connected by a pivot bolt or hinge. When the bolt or hinge is locked in place, the invention forms a horizontally rigid assembly, holding the concrete form walls or other objects apart. The hinge or bolt is released by drawing of a wire coupled through a retention member on a lock. When released, the brace pivots about the crossbars, permitting easy extraction of the brace from the forms.

13 Claims, 5 Drawing Sheets

TELESCOPICALLY ADJUSTABLE SUPPORT BRACE

RELATED APPLICATIONS

The present invention was first described in Disclosure Document Registration 529,688 filed on Apr. 21, 2003 under 35 U.S.C. §122, 37 C.F.R. §1.14 and MPEP § 1706. There are no previously filed, nor currently any co-pending applications, anywhere in the world.

BACKGROUND OF THE INVENTION

1. Field of the Invention

The present invention relates generally to an adjustable brace, and more particularly, to a telescopically adjustable support brace for maintaining a fixed distance or length between two objects.

2. Description of the Related Art

Poured concrete walls are a common method for building and/or structure construction. They are relatively easy to build, cost-effective and very long lasting. However, they do require some work especially during the form building process to ensure consistent wall thickness and quality of the final product. Most often workers cut 2×4's to use as bracing to hold the form walls apart. However, this procedure has several disadvantages. First, the process is very labor intensive and takes a great deal of time. Second, the wood braces must be pulled out right before the concrete level reaches it, which is difficult to do, considering the rigid nature of the wood. Finally, while some wood braces can be reused for a few times, many of the braces must be discarded after just one use which wastes natural resources and increases landfill levels. Accordingly, there is a need for a means by which concrete forms can be held at a constant and consistent dimension without the disadvantages as listed above.

A search of the prior art did not disclose any patents that read directly on the claims of the instant invention; however, the following references were considered related:

U.S. Pat. No. 4,052,031, issued in the name of Melfi, discloses an adjustable concrete form apparatus comprising a pair of spaced form sections properly spaced by spreader sleeves and adjustment means;

U.S. Pat. No. 4,202,145, issued in the name of Coulter et al., discloses a cast-in-place concrete slab pouring form comprising exterior wall sections containing a series of vertically aligned slots arranged in parallel horizontal rows that can be telescoped into overlapping relation and locked into a free standing position;

U.S. Pat. No. 4,949,935, issued in the name of Lee, discloses an apparatus for positioning and supporting an inner mold panel of a form comprising a plurality of supporting members on which the inner steel form mold panels are placed and a plurality of jack devices;

U.S. Pat. No. 5,085,398, issued in the name of Holcomb et al., discloses an adjustable form brace for supporting elevated concrete form floors between support beams comprising two legs connected together at their top by a cradle assembly so that the legs can in a scissors manner;

U.S. Pat. No. 5,219,473, issued in the name of Sandwith, discloses an adjustable concrete formwork system comprising at least two spatially oriented upper sleeves with an upper web located on one side of the sleeves, and at least two spatially oriented lower sleeves, and at least two members telescopically connecting upper and lower sleeves therebetween;

U.S. Pat. No. 5,393,033, issued in the name of Wilson, discloses an adjustable side form concrete mold for varying the height of a side form on a casting bed to any desired height;

U.S. Pat. No. 6,394,410, issued in the name of Thompson, discloses an adjustable reinforcement insertion guide for a slip form concrete barrier mold comprising a vertically disposed slide gate, a vertically disposed reinforcement screen guide depending from the slide gate; and U.S. Pat. No. 6,519,906, issued in the name of Yost et al., discloses corner assemblies for concrete form panels, each assembly comprising a dihedral bend, wherein the members are spaced apart by a selected distance and a removable bridge is disposed between the pair of rigid members.

Consequently, there exists a continuous need for new ideas and enhancements for existing products in the concrete forming industry.

SUMMARY OF THE INVENTION

It is therefore an object of the present invention to provide a telescopically adjustable support brace.

It is a feature of the present invention to provide a telescopically adjustable support brace having a pair of crossbars cooperatively and pivotally coupled so that the crossbars are pivotal about one another when required.

It is another feature of the present invention to provide a brace having telescopically adjustable arms for expanding or contracting the length of the brace.

It is another feature of the present invention to provide a brace having pins or cotter-less hitch pins inserted through apertures formed on the arms and crossbars, the pins securing the arms and crossbars at fixed lengths.

It is another feature of the present invention to provide a brace having cleats distally affixed at the ends of the arms.

It is another feature of the present invention to provide a brace having cleats that are threadably adjustable between minor lengths for fine adjustment.

It is another feature of the present invention to provide a brace having a lock, the lock having an elongated body with a head terminus and a tail terminus, the tail terminus affixed to a crossbar, and with a downward projection at the head terminus of the body for insertion and impingement within a cavity formed in the opposite crossbar.

It is another feature of the present invention to provide a brace having a guard encompassing the lock, wherein the guard prevents hyper extension of the lock and damage and/or failure of the lock.

It is another feature of the present invention to provide a retention member along an anterior surface of the lock, the retention member comprising an orifice for receiving a wire, wherein a user may collapse, pivot or fold the crossbars upward by urging the wire upward, thereby allowing the crossbars to pivot and permit extraction of the brace from a considerable distance or height.

Briefly described according to one embodiment of the present invention, a telescopically adjustable support brace is used to hold concrete form work at the proper dimension during pouring operations. The brace utilizes two sets of crossbars and adjustable arms, which slide inside of one another and are locked into place using a pin in a series of equally spaced apertures. At the distal ends of each arm, a cleat is provided which is serrated in nature and which digs into the form wall to prevent slippage. The cleats are connected to the arms by a threaded rod, which allows for an infinite range of fine adjustments by simply rotating the cleats. The crossbars are connected by a pivot bolt or hinge, which is held in place by a spring. When the bolt or hinge is locked in place, the invention forms a rigid assembly, which holds the concrete form walls apart. The hinge or bolt is released by pulling up on it with the aid of a wire tie, which is threaded through a retention member coupled to the clip. When it is released, the brace pivots about the crossbars, which allows it to be easily removed through the top of the form, and the concrete pour can continue. The use of the brace allows for the pouring of concrete walls in not only a quicker manner when compared to conventional methods, but in a more accurate manner as well.

It is an advantage of the present invention to provide a brace that is easily disassembled after use, thereby permitting a user to remove excess concrete from the brace and prevent damage and/or failure to the brace for subsequent use.

It is a further advantage of the present invention to provide a brace that is easily extracted from the pouring forms as the level of concrete rises therein.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within FIGS. 1 through 9.

1. DETAILED DESCRIPTION OF THE FIGURES

Figure 1:
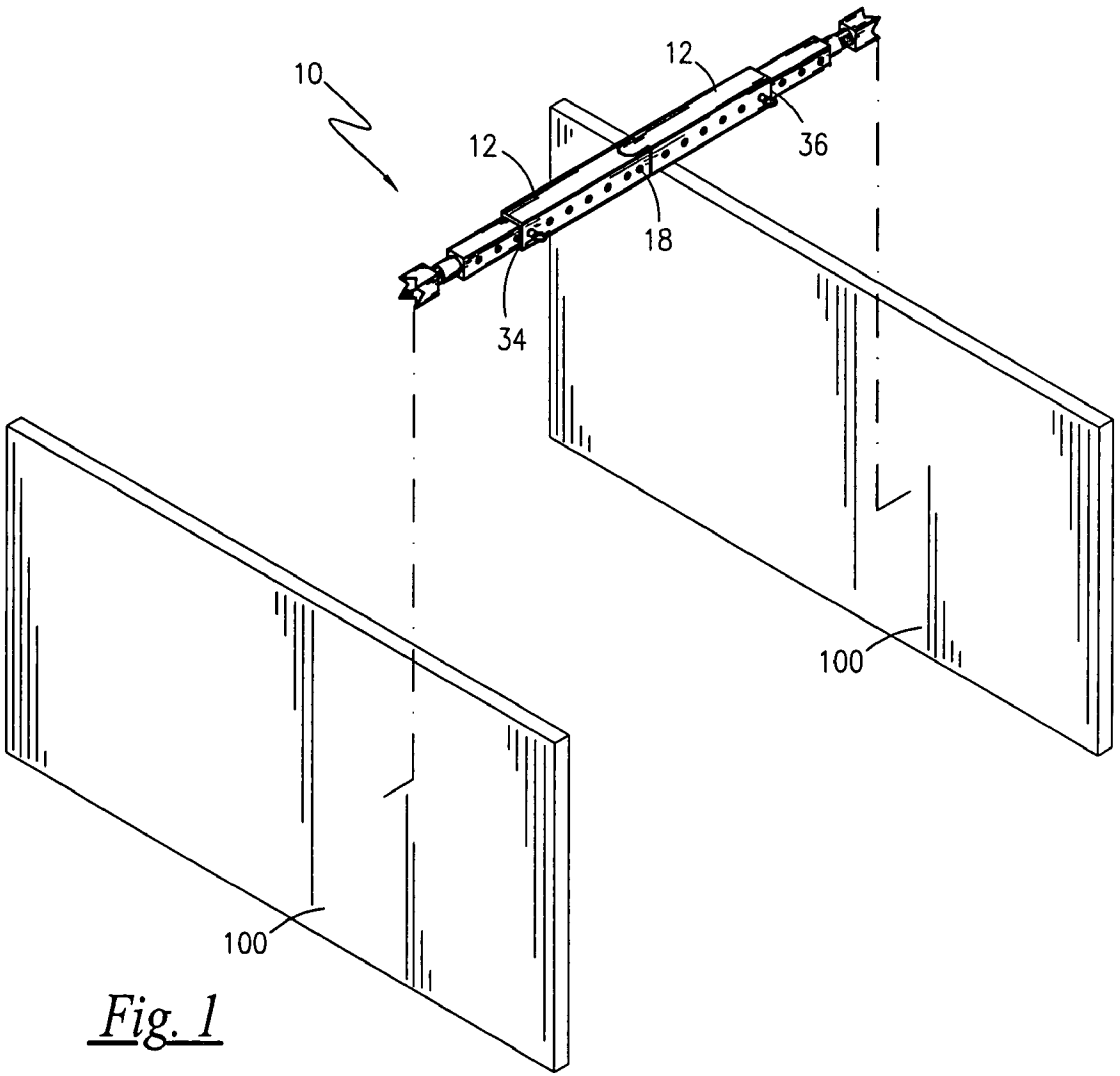
FIG. 1 is an exploded perspective view of the telescopically adjustable support brace insertable between wall forms for manufacturing concrete walls.
Figure 2:
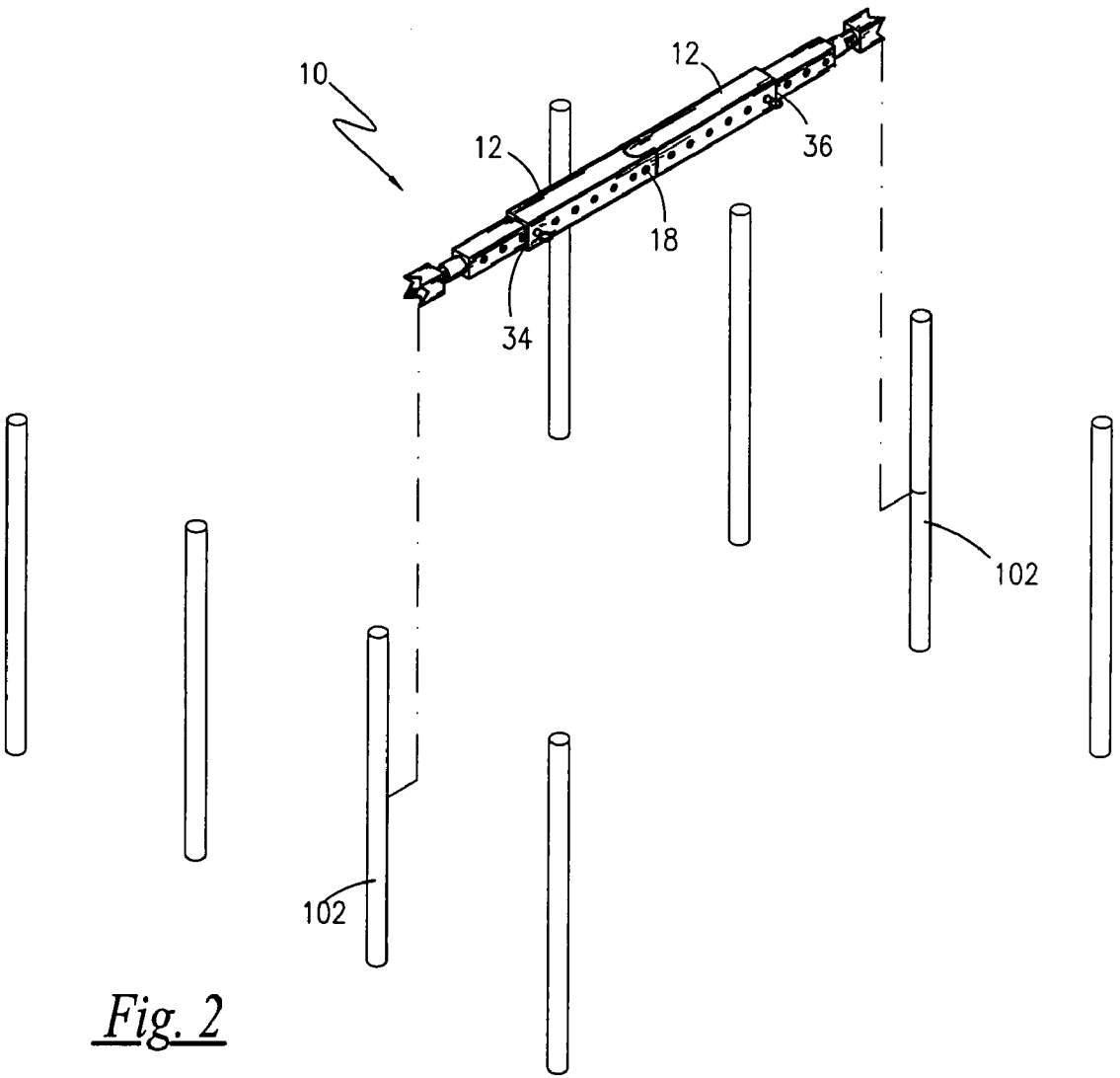
FIG. 2 is an exploded perspective view of the brace insertable between reinforcement bar (as shown)
Figure 3:
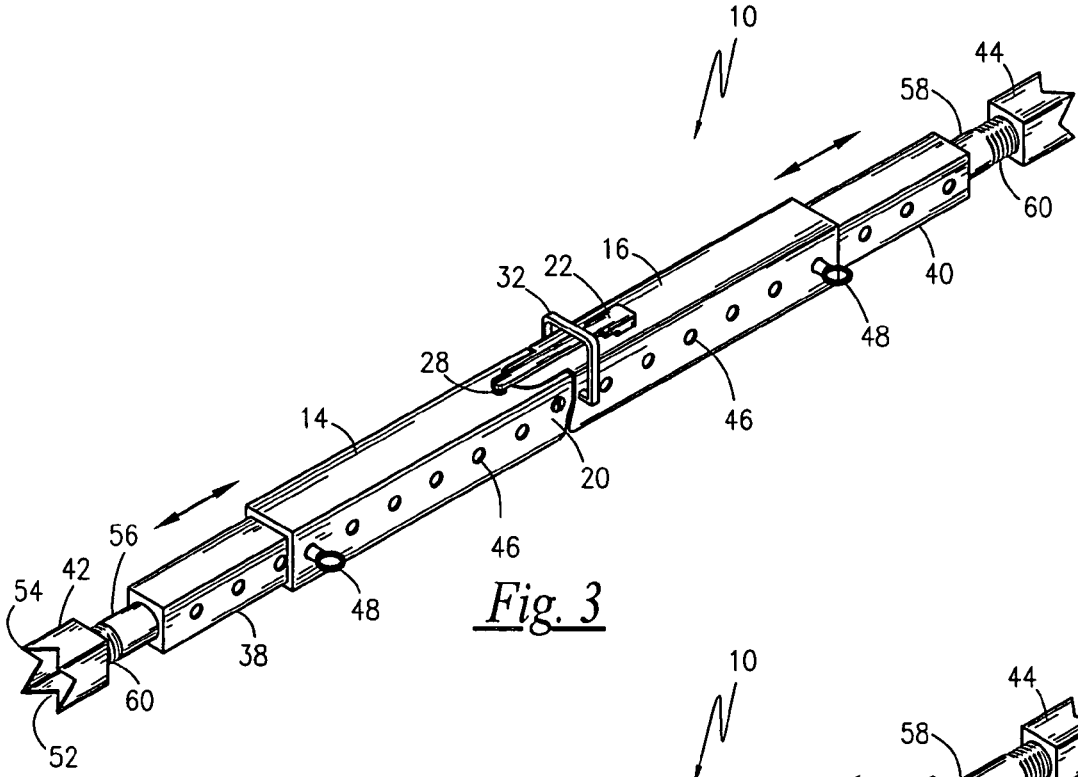
FIG. 3 is a perspective view of the brace.
Figure 4:
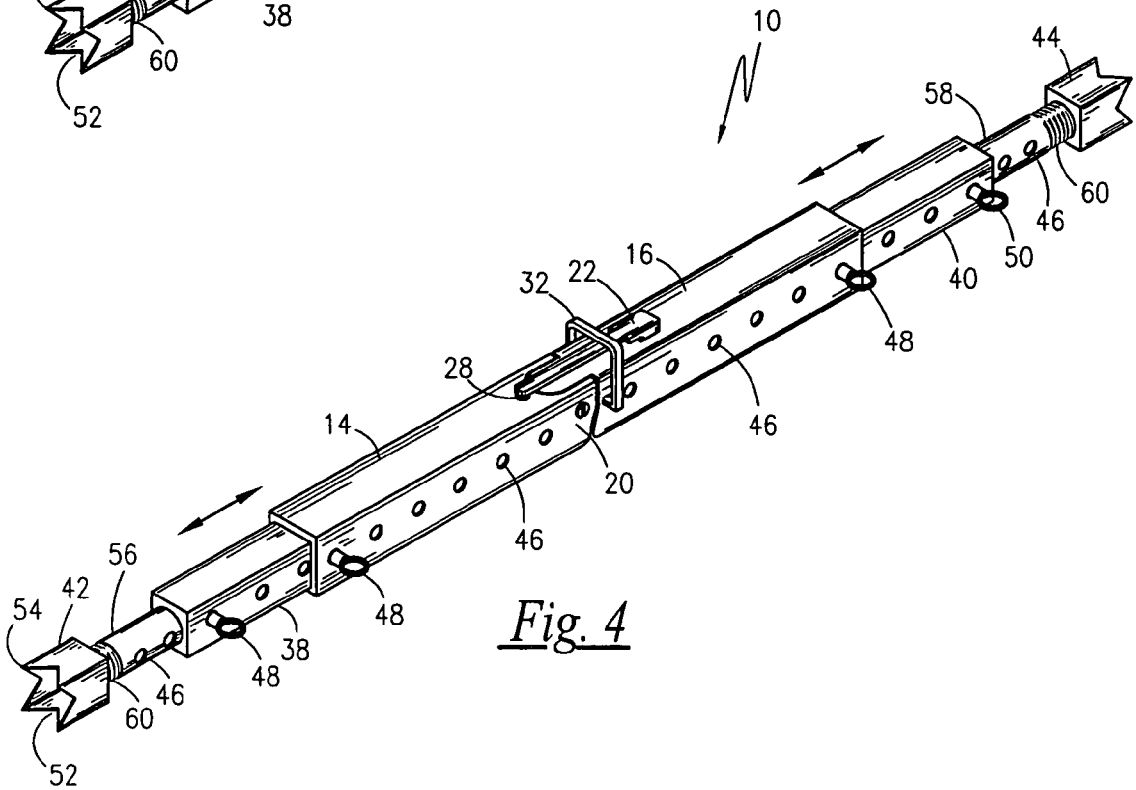
FIG. 4 is another perspective view of the brace.
Figure 5:
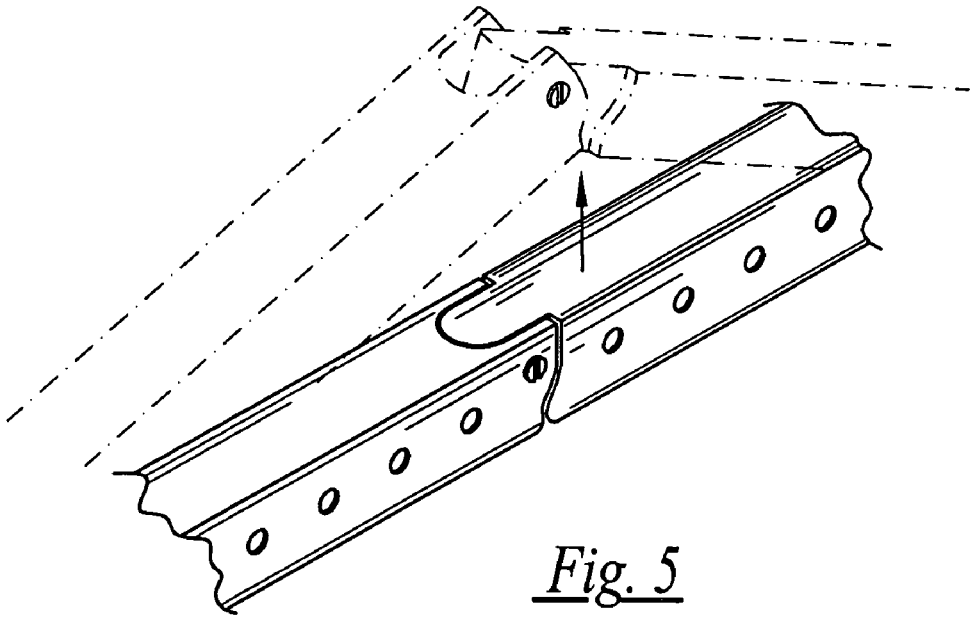
FIG. 5 is a partial perspective view of the brace and the pivotal articulation that the brace performs about the pivoting hinge or bolt.
Figure 6:
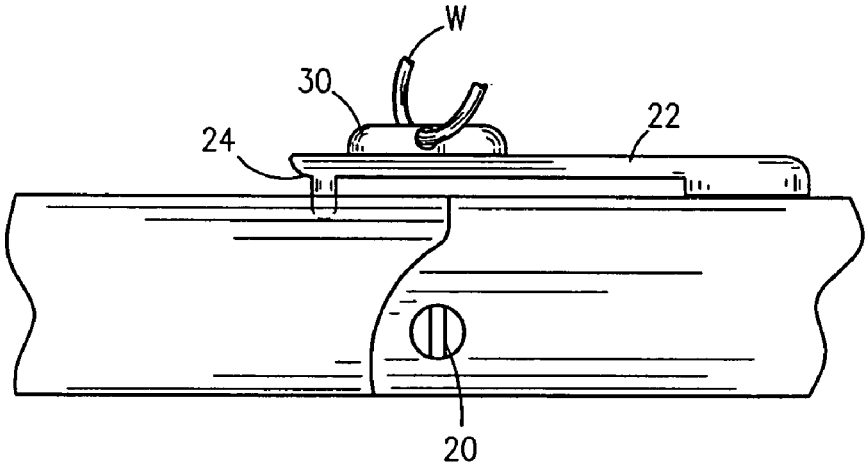
FIG. 6 is a front perspective of the brace illustrating the clip with retention member and wire inserted therethrough.
Figure 7:
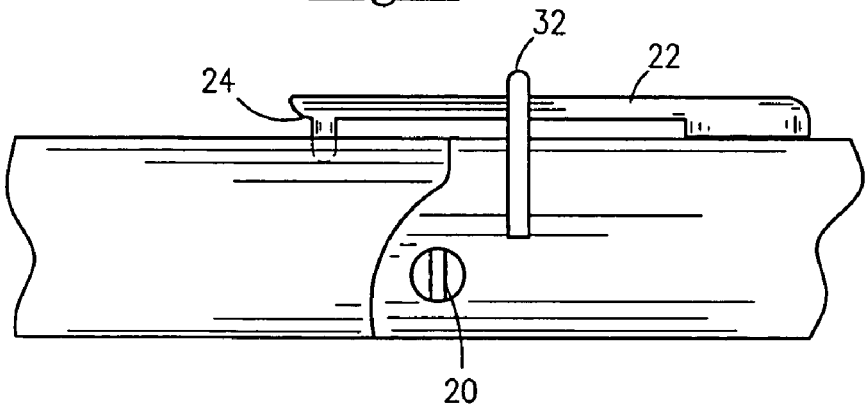
FIG. 7 is a front perspective of the brace illustrating the lock that further secures the clip to the crossbar.
Figure 8:
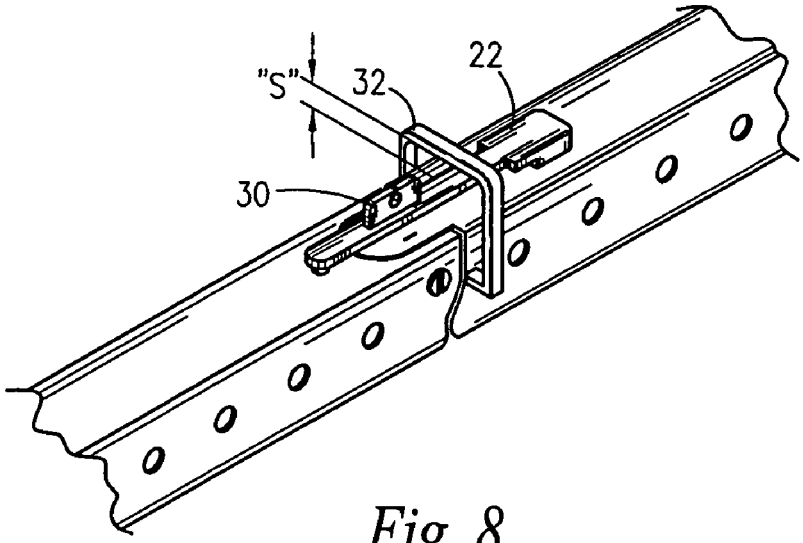
FIG. 8 is a perspective view of the brace also illustrating the lock in position.
Figure 9:
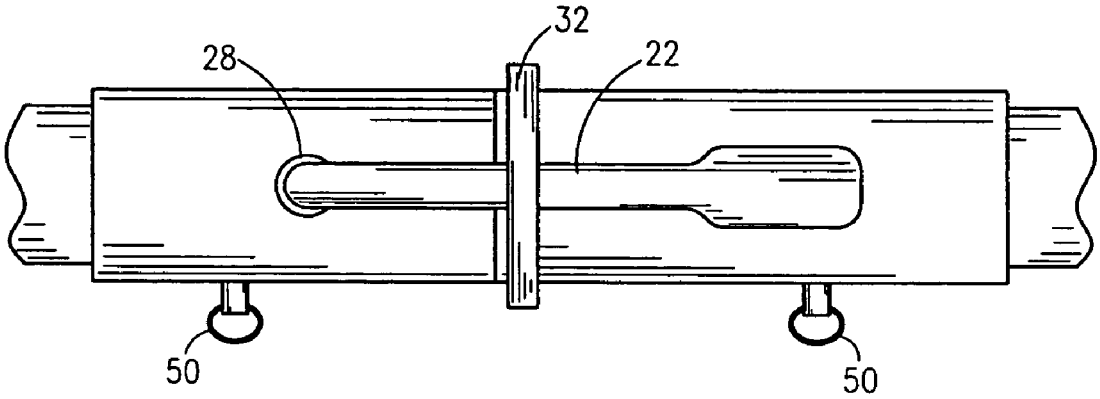
FIG. 9 is a top view of the clip with the clock and cotter-less hitch pins for securing the arms and crossbars at fixed lengths.

Referring now to FIG. 1 through FIG. 9, a telescopically adjustable support brace 10 (hereinafter "brace") is shown in accordance with a preferred embodiment of the present invention. The brace 10 is envisioned for use in maintaining a specified linear distance or width between two objects, especially two objects that may tilt beyond a vertical or substantially vertical position. By way of example only, and not a limitation on the scope of the invention as claimed, in FIG. 1, the brace 10 is shown in supporting two wall forms 100 to prevent tilting of the wall forms 100 toward one another. In FIG. 2, the brace 10 is shown in supporting two upstanding reinforcement bars 102 (or re-bar as it is known in the trade). The brace 10 comprises a linearly elongated crossbar (generally denoted as 12) terminating at opposing ends 34 and 36. The brace 10 also includes a pair of adjustable arms 38 and 40, wherein each one of the pair of arms 38 and 40 is inserted at an end 34 and 36 of crossbar 12 and are telescopically adjustable therein. The brace 10 further includes a pair of cleats 42 and 44, wherein each one of the cleats 42 and 44 is distally affixed to an arm 38 and 40, respectively.

The crossbar 12 comprises a first crossbar 14 and a second crossbar 16 pivotally coupled about pivot means 18. Pivot means 18 is envisioned as any mechanism that permits the first crossbar 14 and second crossbar 16 to pivot as required, the pivoting about pivot means 18 resulting in crossbar ends 34 and 36 assuming a lower profile position relative to pivot means 18. Included among the envisioned mechanisms are hinges of various types, pivot bolt 20, or a lock 22, or a combination of the recited mechanisms.

The clip 22 comprises an elongated body having a head terminus and a tail terminus, wherein the tail terminus affixed to the first crossbar 14 or the second crossbar 16. At an opposite head terminus of the lock 22, a projection 24 extends downward therefrom, the projection 24 inserted into and impinged within a cavity 28 formed in the opposite crossbar 14 or 16. The projection 24 and cavity 28 are coupled (when desired) in an impinging manner to maintain the horizontal integrity of the brace 10 during use. For illustration and example only, the lock 22 is affixed to second crossbar 16 and the cavity 28 is formed in the first crossbar 14. Along an upper or anterior surface of the lock 22, a retention member 30 is provided for receiving wire (denoted as W in the figures), cable, rope, string, twine or other similar items. Wire W, for example, is passed through the retention member 30. The wire permits a user to manually pivot first crossbar 14 and second crossbar 16, thereby releasing the brace 10 from between the objects the brace 10 supports. The incorporation of retention member 30 and wire is advantageous in use with concrete forms and reinforcement bar, wherein the user can safely and conveniently observe from a distance and then extract the brace 10 by tugging on the wire, releasing the projection 24 from the cavity 28, resulting in pivotal collapsing of first crossbar 14 and second crossbar 16, thus releasing the brace 10 from between the objects. A lock retainer or guard 32 may be included to further secure the lock 22 to the cavity 28. The guard 32 is envisioned as being either permanently or semi-permanently affixed to crossbar 14 or 16 to which the lock 22 is affixed at the tail terminus and encompassing the lock 22. As shown, the guard 32 is affixed about one or both of its ends to the crossbar 16. To release the lock 22 from cavity 28, the guard 32 is positioned so that a space or interstice S exists between the lock 22 and guard 32. The space/interstice S allows the lock 22 to urge upward when influenced by tugging on wire W. Upward urging of lock 22 releases projection 24 from cavity 28, and thus releases crossbars 14 and 16 from one another. The guard 32 further prevents hyper extension of lock 22 and potential damage and/or failure of lock 22 in subsequent uses.

The first crossbar 14 and second crossbar 16 each comprise a plurality of apertures 46 that traverse the respective diameters of crossbars 14 and 16. The apertures 46 are provided to cooperatively correspond with a plurality of apertures 46 formed in arms 38 and 40. Alignment of the apertures 46 of the crossbars 14 and 16 with the apertures 46 of the arms 38 and 40 permits insertion of pins 48 to securely position arms 38 and 40 within the crossbars 14 and 16 at a fixed length. In an alternate embodiment, cotterless hitch pins 50 are used, wherein a user would remove the hitch pin 50, releasing the impingement on arm 38 or 40, thereby permitting telescopic adjustment of the arms 38 and 40. In one envisioned embodiment, the apertures 46 are provided at approximately one inch intervals, although other linear intervals are envisioned. The intervals are envisioned as providing the greatest flexibility in allowing specific linear distances between objects, and in combination with the fine adjustment provided by the cleats 42 and 44 and shafts 56 and 58, respectively, a user will be able to achieve precise linear lengths of the brace 10 for supporting objects upstanding at specific linear distances.

The cleats 42 and 44 each comprise a plurality of recesses 52 for receiving a rod/bar 102. The recesses 52 shown in the figures are formed from a V-shape, but other shapes and configurations are envisioned. The configuration illustrated by the figures illustrate the recesses 52 forming points, or crimps 54 provided for situations in which objects may be wider or larger than the recesses 52 in cleats 42 or 44. The points 54 act to press against the objects (such as concrete wall forms 100), bracing the objects and maintaining a fixed length or distance between the objects. The cleats 42 and 44 are envisioned as providing resistance to inward collapse of a wall form 100 (in one example) and for preventing lateral and longitudinal displacement due to shifting that may occur during use. The cleats 42 and 44 are affixed to threaded shafts 56 and 58 depending from the arms 38 and 40. The threads 60 are provided to allow for fine adjustment of the brace 10 once an appropriate length is established. By rotating the cleats 42 or 44 about the respective threads (the cleats having corresponding complimentary threads), a user can perform minor adjustments in length about the brace 10. The cleats 42 and 44 may also be affixed or coupled with shafts 56 and 58 via a coupling nut (not shown) therebetween, wherein the nut is permanently affixed to the cleats 42 and/or 44 and then receives the threads 60 from shafts 56 and/or 58. In one envisioned embodiment, shafts 56 and 58 are coupled with arms 38 and 40 via a permanent attachment, which may be accomplished by welding or another similar means. In another envisioned embodiment, shafts 56 and 58 are coupled with arms 38 and 40 by alignment of apertures 46 formed in arms 38 and 40 with apertures 46 formed in shafts 56 and 58 and impinged by pins 48 or 50.

Because the invention is particularly envisioned as advantageous in use with wall forms 100 (or reinforcement bar used to reinforce poured concrete), the brace 10 is envisioned as being commercially available in dimensions particularly suited for such use. As such, three sizes are envisioned: a minimum length (between twelve inches and eighteen inches), an intermediate length (between eighteen inches and thirty inches) and an maximum length (between thirty inches and fifty-four inches). These three sizes are intended to account for a majority of the fixed lengths between wall forms 100 (or reinforcement bar 102) used on construction sites, spanning the desired thickness of the subsequently completed concrete wall.

It is envisioned that the brace 10 is constructed from a durable and sturdy material, such as steel or other suitable metals, although hardened plastics are also envisioned. It is recommended that any excess concrete or cement, or other foreign material, that accumulates on the brace 10 is removed as quickly as practicable to prevent hardening of the material and damaging, limiting the use or shortening the useful life of the brace 10, especially concerning the apertures 46 being plugged by material, or interference of the telescopic nature of the arms 38 and 40.

2. OPERATION OF THE PREFERRED EMBODIMENT

To use the present invention, in accordance with a preferred embodiment of the present invention, the brace 10 is adjusted to an approximate length spanning the linear distance or width between two objects, such as the wall forms 100 or reinforcement bars/rods 102 shown in the figures. Adjustment is accomplished by removing the pins 48 or pins 50 so as to release the arms 38 and 40 from impingement with the crossbars 14 and 16. The arms 38 and 40 are then telescopically adjusted. Upon appropriate adjustment, the pins 48 or 50 are returned to impinge the arms 38 and 40 and crossbars 14 and 16. The cleats 42 and 44 are then rotated about the threads 60 to finely adjust the length. A wire, cable, rope, twine or string is threaded through a retention member 30 at the top of lock 22. When the brace 10 is no longer needed at the position it is set, a user can tug on the wire or cable, which pulls the retention member 30 upward, releasing the lock 22 from the cavity 28, and thereby allowing the crossbars 14 and 16 to pivot upward and allow for the brace 10 to be removed from between the objects, the objects envisioned include wall forms, reinforcement bar, upstanding poles, rods, dowels, lumber, or other similar items.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents. Therefore, the scope of the invention is to be limited only by the following claims.

What is claimed is:

1. A telescopically adjustable support brace comprising:

a linearly elongated crossbar terminating at opposing ends, wherein said crossbar comprises a first crossbar and a second crossbar pivotally coupled about pivot means, wherein said pivot means further comprises a lock and wherein said lock comprises an elongated body having a head terminus and an opposing tail terminus, said head terminus includes a downwardly extending projection, and said tail terminus affixed to one of said first crossbar and said second crossbar;

a pair of adjustable arms, wherein each one of said pair of arms is inserted into one of said ends, said pair of arms telescopically adjustable therein; and a pair of cleats, wherein each one of said cleats is distally affixed to one of said pair of arms; wherein said pair of arms are adjustably set at a fixed linear length for maintaining a fixed linear distance between two objects.

2. The brace of claim 1, wherein said projection is insertable into a cavity formed on one of said first crossbar or said second crossbar opposite said tail terminus, said projection and said cavity coupled to maintain horizontal integrity in said brace.

3. The brace of claim 1, wherein said lock further comprises a retention member formed on an anterior surface of said lock, said retention member comprising an orifice for receiving a wire.

4. The brace of claim 3, wherein upward urging of said wire disengages said projection from said cavity, thereby releasing said first crossbar and said second crossbar to pivot about said pivot means and permit extraction of said brace.

5. The brace of claim 1, wherein said lock further comprises a guard encompassing said lock, a interstice provided between said guard and said lock so as to permit upward urging of said lock by a retention member and a corresponding wire passed therethrough, said guard preventing hyper extension of said lock and thereby preventing damage or failure to said lock.

6. The brace of claim 1, wherein said pivot means comprises a pivot bolt.

7. The brace of claim 1, wherein apertures are formed in said crossbar and said pair of arms, said apertures on said crossbar aligned with said apertures on said pair of arms and receiving a pin therethrough to impinge at a fixed linear length.

8. The brace of claim 7, wherein said apertures are spaced at approximately one inch intervals.

9. The brace of claim 1, wherein each one of said pair of cleats is threadably adjustable to achieve fine adjustment of a linear length of said brace.

10. The brace of claim 1, wherein each one of said pair of cleats alternately comprises a plurality of points and a plurality of recesses intermediate thereto.

11. The brace of claim 10, wherein said plurality of points are provided to enhance resistance against inward collapse of said two objects.

12. The brace of claim 1, wherein said brace is easily disassembled after use so as to remove excess concrete accumulated therein.

13. The brace of claim 1, wherein displacement of said ends permits extraction of said brace from between said two objects.

* * * * *